US005454409A

United States Patent [19]

McAffer et al.

[11] Patent Number: 5,454,409

[45] Date of Patent: Oct. 3, 1995

[54] TRANSFER ADAPTORS

[75] Inventors: Ian G. C. McAffer, Biggin Hill; Howard Rose, St. Helen's; David Wilson, Stoke-on-Trent, all of England

[73] Assignee: Waverly Pharmaceutical, Ltd., Runcorn, United Kingdom

[21] Appl. No.: 253,429

[22] Filed: Jun. 2, 1994

Related U.S. Application Data

[63] Continuation of Ser. No. 836,654, Feb. 18, 1992, abandoned.

[30] Foreign Application Priority Data

Feb. 15, 1991 [GB] United Kingdom ..... 9103291

[51] Int. Cl.[6] ..... B65D 1/04

[52] U.S. Cl. ..... 141/329; 141/330; 141/363; 604/240; 604/243

[58] Field of Search ..... 141/329, 27, 84, 141/330, 312, 363, 364, 365, 375, 382, 83, 18; 604/403, 415, 408, 410, 411, 412, 414, 416, 905, 240, 243, 283; 128/912, 203.21

[56] References Cited

U.S. PATENT DOCUMENTS

| | | | |
|---|---|---|---|
| 2,551,315 | 5/1951 | Christopher et al. | 604/403 |
| 3,059,643 | 10/1962 | Barton | 141/370 |
| 3,108,572 | 10/1963 | Hassing et al. | 604/243 |
| 3,917,063 | 11/1975 | Ghibret et al. | 141/329 |
| 4,493,348 | 1/1985 | Lemmons | 141/1 |
| 4,573,993 | 3/1986 | Hoag et al. | 604/411 |
| 4,781,701 | 11/1988 | Geprägs | 604/240 |
| 4,834,152 | 5/1989 | Howson et al. | 604/415 |
| 4,944,736 | 7/1990 | Holtz | 604/403 |
| 4,997,429 | 3/1991 | Dickerhoff et al. | 604/411 |
| 5,125,415 | 6/1992 | Bell | 604/403 |

FOREIGN PATENT DOCUMENTS

| | | | |
|---|---|---|---|
| 0327519 | 9/1989 | European Pat. Off. | A61J 5/00 |

*Primary Examiner*—Henry J. Recla
*Assistant Examiner*—David J. Walczak
*Attorney, Agent, or Firm*—Edward H. Renner

[57] ABSTRACT

The present invention relates to a transfer adaptor for use with a vial containing ingredients to be reconstituted, an ampoule containing a reconstituting fluid and a syringe, the adaptor being made preferably of plastic, thereby cutting down on the wasteful use of many needles and reducing the problem of sharps.

20 Claims, 3 Drawing Sheets

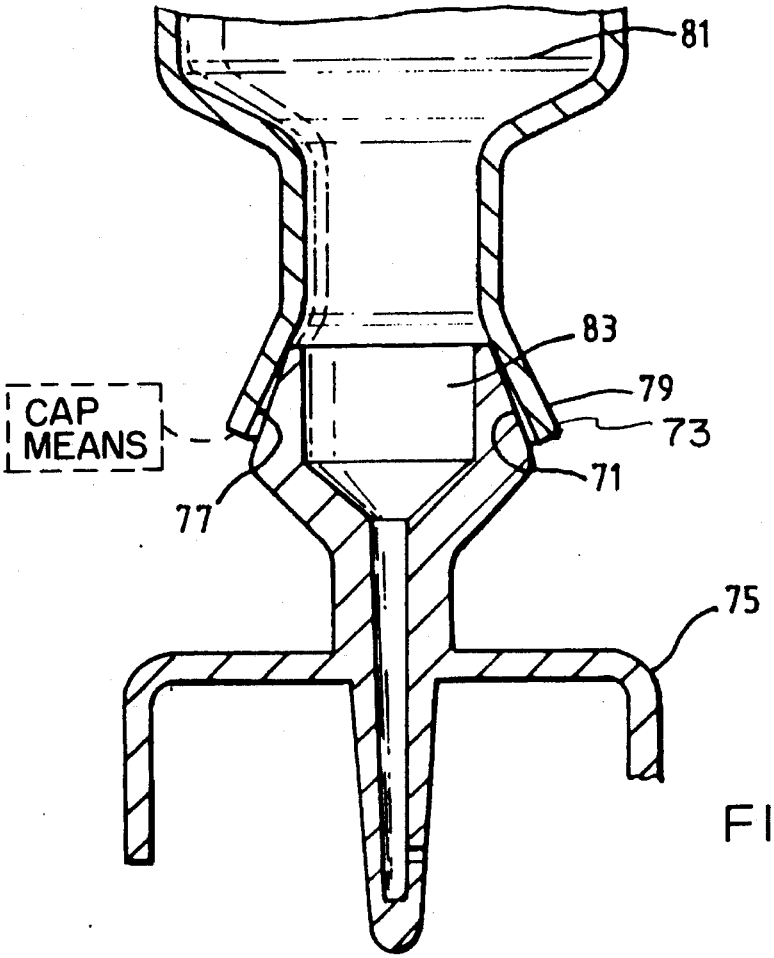
FIG.3
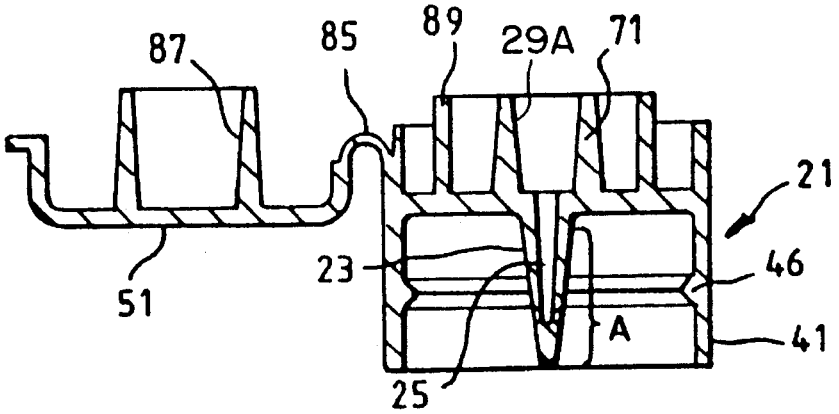
FIG.4
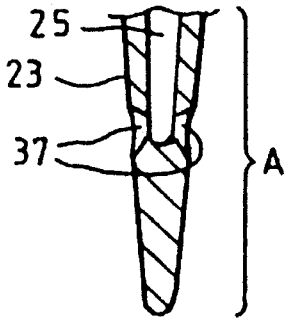

TRANSFER ADAPTORS

This application is a continuation of U.S. patent application Ser. No. 07/836,654, filed Feb. 18, 1992, now abandoned.

BACKGROUND TO THE INVENTION

The present invention relates to a transfer adaptor for effecting fluid communication between a vial and another container. The invention is especially, but not exclusively, suited to use in the reconstitution of injectable preparations.

It is common practice in hospitals to reconstitute injectable preparations provided in septum-sealed vials by piercing the septum with a wide bore needle and introducing sterile water or other appropriate liquid from a syringe attached to the latter. The sterile water is first drawn into the syringe from a sterile-sealed ampoule. The wide bore needles and ampoules are disposed of after use, which is wasteful.

Next, at least some of the reconstituted preparation is taken back up into the same syringe via the needle. The wide bore needle is then removed from the syringe and disposed of. It is replaced by a narrow bore needle for injection into the patient (intramuscularly, subcutaneously etc as appropriate).

Subsequent doses, if any, are taken up in the same way, using a new wide bore needle for uptake at each occurrence, followed by disposal of same and substitution by another narrow bore needle. It is apparent that this procedure in general is very wasteful of needles. Moreover, it tends to cause degradation of the septum, especially with multiple use, resulting in a loss of sterility.

The primary mechanism of this degradation is known as "coring" whereby the opening at the needle tip removes a section of the septum. The resulting fragment may fall into and contaminate the contents of the vial or else block the needle. The wide bore needles are used for uptake, inter alia to minimize coring, but cannot completely overcome the problem.

FIG. 1 shows a known device 1 for multiple extraction from a vial after reconstitution by the conventional method. This device provides a hollow steel needle 3 terminating in a female luer 5 at the end 7 opposite to the open needle point 9. The needle is used to pierce the septum 11 of a vial.

Syringes without needles attached are then successively attached to the luer to draw-up individual doses. The flange 13 limits the extent of insertion and the cap 15 is used to close the device between uses. However, this known system does not solve the problem of coring and septum degradation, if a wide bore needle is first employed to reconstitute the preparation in the vial.

It is also known to provide a transfer adaptor comprising a steel needle having a point at each end, thereby to transfer contents between two septum-sealed bottles, an integral collar or shroud surrounding each point.

All such transfer systems described above employ steel needles of one kind or another. However, recently there has been a growing demand to minimize use of such needles. The intention is to avoid accidental pricks or scratches from needles which may be contaminated with virally infected blood. There have been several reported incidents of hospital staff becoming infected with AIDS or hepatitis B in this way.

BRIEF DESCRIPTION OF THE INVENTION

It is an object of the invention to provide means for facilitating transfer of fluids between containers and vials, wherein the vial contains a substance to be reconstituted and the container contains a reconstituting fluid, and wherein the transfer means does not core the septum of the vial.

It is a further object to provide such a transfer means which is further capable of facilitating uptake of the reconstituted substance by a syringe, thereby reducing the number of times the septum must be pierced.

We have now discovered that a transfer adaptor for use with a vial containing ingredients to be reconstituted, an ampoule containing a reconstituting fluid and a syringe, wherein the adaptor is made preferably of plastic, is able to cut down on the wasteful use of many needles and reduce the problem of sharps.

Thus, in a first aspect, the present invention provides a transfer adaptor for fluid communication between a vial and a syringe, comprising a cannula for piercing a septum of the vial, a collar to prevent the adaptor passing into the vial through the septum, the cannula comprising a female receptor to receive the male exit nozzle of a syringe at the distal end of the cannula, characterized in that there is further provided, at the distal end of the cannula, a male receptor for the female opening of a reservoir whose contents are intended for transfer into the vial.

BRIEF DESCRIPTION OF THE DRAWINGS

FIG. 3 shows an alternative connector arrangement for the adaptor and system illustrated in FIG. 2;

FIG. 4 shows a further embodiment of the invention;

DETAILED DESCRIPTION OF THE INVENTION

Figure 1:
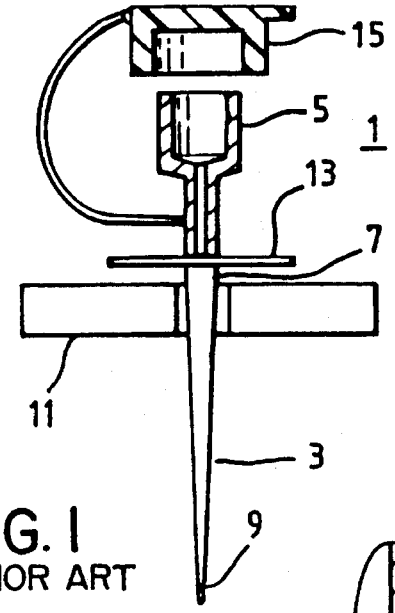
FIG. 1 PRIOR ART
FIG. 1 shows a known transfer device.

Many configurations of the transfer adaptor of the present invention will be apparent to those skilled in the art, and various of the preferred embodiments are set out below.

The preferred reservoir whose contents are intended for transfer to the vial is a blow-fill seal ampoule. Such ampoules are well known in the art, and generally comprise a substantially regular shaped body having a supported, constricted neck. The neck then opens out slightly, generally in the form of a female luer, at the rim of which is sealed the cap, shown as "cap means" in FIGS. 2 and 3. This cap can be generally broken off by means of a frangible membrane around the female luer, so that the user only has to exert a sharp sideways pressure on the cap in order to reveal the contents of the ampoule via the female luer.

In the present invention, the male receptor of the transfer adaptor, in a preferred embodiment, is adapted to fit snugly into the female luer. Thus, when the assembled amopule and transfer adaptor are fitted into a vacuum-sealed vial, the vacuum will serve to encourage transfer of the ampoule contents into the vial. It will be appreciated that such transfer will be greatly facilitated by positioning the ampoule above the vial.

Configuration of the male portion of the transfer adaptor to fit within the female neck of the ampoule will generally take one of two forms. The first is to configure the male receptor of the transfer adaptor such that the contours of the male receptor exactly fit those of the female luer. This can be advantageous where a large number of transfer adaptors is manufactured in tandem with a large number of ampoules. However, if it is not known what type of ampoule is to be used in conjunction with the transfer adaptor, then it may be preferable to provide a transfer adaptor with an elongated male receptor. Thus, the base of the receptor will be broader than it is expected to encounter with a female neck of an ampoule, while the tip of the receptor will be narrower. Accordingly, such a receptor could be expected to fit most types ampoule available on the market.

In addition, it will be appreciated that transfer adaptors may be specifically tailored to fit specific types of ampoule. This may particularly be the case where ampoules contain specific substances rather than pharmaceutical grade saline. Thus, the transfer adaptor and the ampoule must be matched before transfer of the contents of the ampoule into the vial, thereby providing a double check that the contents of the ampoule are those which it is desired to transfer into the vial.

From the foregoing, it will be appreciated that the male portion of the transfer adaptor is preferably essentially luer-shaped, but that it may be any suitable shape to cooperate with any suitable ampoule, as desired. It will be appreciated that the term "luer" defines a specific frustoconical shape, whether male or female. Accordingly, "essentially luer-shaped" defines a frustoconical shape which, while not necessarily being a luer, is generally similar thereto.

The cannula of the transfer adaptor of the present invention is preferably in the form of a needle. In order to prevent coring, the opening of the cannula is preferably either set off-centre, or the edges of the rim are rounded. In practice, the walls of the cannula are likely to be so thin at the lip, that rounding the edges of the rim is unlikely to adequately prevent coring. Accordingly, it is preferred to provide the exit of the cannula bore in the side of the cannula.

It will be appreciated that as many openings as desired may be provided to permit maximum flow of fluid from the ampoule to the vial, but one is generally sufficient. Further, in practice, where the cannula is made of plastics material, then only one opening tends to be of practical use, as the bore is provided by a forming rod during injection molding. A requirement for two or more openings to the bore would then be a major inconvenience. However, the present invention envisages the provision of more than one opening to the bore, such as by drilling holes in the side of the cannula.

It will be appreciated from the foregoing, that the cannula may be made of plastics material. This is preferred where the entire transfer adaptor is injection molded in one piece. However, this is not a requirement of the present invention, and the cannula may be provided as a metal needle, for example. Such a needle could then a ultrasonically welded, or glued, into the remainder of the transfer adaptor.

While it is possible to provide the transfer adaptor of the present invention entirely in a suitable metal, such as light steel or aluminum, this will tend to be prohibitively expensive for mass manufacture. Such metal transfer adaptors would generally be intended for extended reuse, for example by autoclaving the transfer adaptor after use.

It is preferred to provide at least that part of the transfer adaptor, other than the cannula, in plastics material. It is further preferred to provide this part as an integral portion into which the cannula can be fitted. One such example of this would be a frustoconical male receptor fitted with a plastics collar which could then fit over the needle. Problems could occur here if the needle were tapered all of the way to the tip, but needles are known which have a substantially cylindrical base and which then taper towards to the tip. Nevertheless, as above, such a construct is unlikely to be commercially viable.

Accordingly, it is preferred to provide the entire transfer adaptor as an integral, injection-molded unit. In such an instance, the cannula could then take the form of a needle of plastics material, such as described above. It is generally preferred to provide such a needle as wide as possible, while still being able to puncture the septum of the vial. This is to permit maximum transfer of fluid. Where the orifice to the bore of the cannula is provided in the side of the cannula, then it is extremely unlikely that any coring will occur. However, even where such coring does occur, it will only occur the once, thereby preventing substantial degradation of the septum.

Similar considerations apply to the female receptor of the transfer adaptor and the male exit nozzle of the syringe as to the male receptor to the transfer adaptor and the female neck of the ampoule. Thus, the female neck, or receptor, of the transfer adaptor may be specifically designed so as to contour with the syringe, or may be tapered in an exaggerated manner so as to fit different types of syringe nozzle. However, by way of contrast to the transfer adaptor/ampoule connection, it is preferred that the female receptor of the transfer adaptor be contoured to fit exactly with the syringe nozzle. This is because the syringe is subject to considerably more manipulation than is the ampoule, so a secure fit, which is unlikely to be disturbed in the natural course of use of the transfer adaptor, is required.

The collar of the transfer adaptor need only be an abutment portion to prevent total penetration of the needle, or cannula, into the septum. However, it is generally preferred that the collar is sufficiently wide to avoid even the remotest likelihood of being pushed through the septum with the needle and, in a preferred embodiment, the collar is sufficiently wide to cover the entire septum.

It is also preferred that the collar, where it covers the entire septum, or at least where portions of the collar reach to the edge of the septum, that there is further provided a dependent flange which extends down the wall of the septum-retaining collar. This flange preferably extends all of the way around the circumference of the septum-retaining collar, but it may be interrupted, so as to provide several dependent members.

It is further preferred that, at the extent of the flange, or flanges, there is provided an inwardly directed finger or catch which is adapted to snap over the septum-retaining collar in use. Thus, when the transfer adaptor is fitted onto the vial, it is prevented from accidental removal by the inwardly projecting fingers.

Where such a flange is provided, it is preferred that it extends beyond the extent of the needle. If this is not the case, then the needle must be exactly positioned in the centre of the septum in order for the flange to cooperate with the septum-retaining collar. Where the flange is longer than the needle, however, the flange can be used to position the needle with the least amount of inconvenience. This also prevents the needle from being inadvertently contacted by the user's fingers, for example.

In a further preferred embodiment, an upwardly directed wall is provided about the male and female receptors of the transfer adaptor. This wall provides much the same purpose as the dependent flange, in that it prevents inadvertent contamination of the receptors, and can also be adapted to cooperate with the ampoule in use. Thus, when the ampoule is fitted on the male receptor, the upstanding wall serves to guide the ampoule into position. The ampoule is then retained in position while the contents are transferred into the vial.

Where the transfer adaptor is intended as a multi-use device, the upstanding wall may also be provided with a cover. This cover may be fitted separately from the transfer adaptor unit, or may be integral. Thus, the cover may be provided during the injection-molding procedure, and be attached by a living hinge.

There is no requirement for the cover to be particularly airtight, as atmospheric contamination is unlikely to play a large part in the use of such devices. Instead, the cover will generally be intended to prevent manual contamination.

While it is generally preferred to provide the transfer adaptors of the present invention as independent units, it is also envisaged that they may form part of the ampoule, for example. Thus, the ampoule may be fitted with a septum which could be punctured by the male receptor of the transfer adaptor when the unit is forced on to a vial. This and other suitable embodiments will be apparent to those skilled in the art.

In a further aspect of the present invention, there is provided a transfer adaptor for effecting fluid communication between a vial and another container, the adaptor comprising a connector for the container and a cannula for piercing a septum of the vial and for allowing passage of fluid between the vial and container, the cannula being provided with an opening in a side wall thereof.

The rim of the opening in the side wall of the cannula does not exert an appreciable force on the septum during insertion as does the opening directly at the tip of a conventional steel needle. Thus, coring is avoided. However, to minimize septum degradation further and to avoid accidental pricks or scratches to the user, it is preferred that the tip of the cannula is not needle sharp and most preferably is rounded. Conveniently, the opening in the side wall is provided at a position so that in use, it will be situated just below the septum. For the same reasons, the cannula is preferably made of a plastics material.

The connector of the adaptor is configured to receive the exit nozzle (male luer) of a syringe without a needle attached to the latter. Sequential filling of several syringes in this way is thereby permitted. When the reconstituted contents of the vial are exhausted, the vial together with the attached adaptor are disposed of. However, another aspect of the present invention overcomes the aforementioned problem of wastage of the wide bore needles used to introduce the sterile water into the vial.

Thus, another aspect of the present invention provides an injection reconstitution system comprising a blow-fill-seal ampoule which contains liquid and a transfer adaptor for effecting fluid communication between the ampoule and a vial.

Blow-fill-seal ampoules are well known in the art, for example as described in EP-A-0 327 397.

If the vial is of the kind sealed with a septum, then the transfer adaptor utilized according to this aspect of the invention preferably should contain means for piercing the septum and for co-operating in the fluid communication between the ampoule and the vial. This means may be a conventional steel needle, a cannula with an opening in the side wall thereof (as recited above) or of any other appropriate kind which may be envisaged by persons skilled in the art.

Whatever the means of connection of the transfer adaptor to the vial, with systems according to this aspect of the present invention, the adaptor is connected to the blow-fill-seal ampoule to permit transfer of the liquid to the vial to reconstitute the contents thereof. Preferably this is facilitated by the vial being sealed under vacuum. In this case, the adaptor should be connected to the blow-fill-seal ampoule before being connected to the vial, for example by piercing of a septum thereof. As used herein, the term "vacuum" refers to any pressure below ambient.

After liquid transfer has taken place, the container is removed to allow subsequent withdrawal of the vial contents.

In systems according to the present invention, it is preferred that the transfer adaptor and blow-fill-seal ampoule are provided with respective complementary fittings to enable them to be manually connected for the required transfer to be effected.

The following are also optional preferred features of transfer adaptors according to the present invention.

The connector of the adaptor may be configured in one respect for connection to a blow-fill-seal ampoule and in another respect for connection to a syringe for extraction of the vial contents. For example, the connector may be formed as a female luer to receive the male luer of a syringe. However, it may also have a tapered external profile to act as a male cone and thereby co-operate with a corresponding female connector on the blow-fill-seal ampoule.

The adaptor may also be provided with a shroud for the cannula or needle as appropriate. The shroud is preferably provided with clips on its lower periphery for clipping over the septum retention collar of the vial. This is especially useful when the vial is intended for multiple uses. Afterwards, the adaptor and vial can be disposed of as a single sharps free unit. Alternatively, the internal surface may be screw thread rifled to aid retention. This does not require a corresponding thread to be provided on the vial neck. Also, for multiple use the adaptor may also be provided with a cap to close it between uses. This cap may be attached via a strap.

In general, it is preferred that all, or as many parts as possible of the adaptor, are integral. Conveniently such an integral structure is manufactured by injection molding of homopolymer- or copolymer- polypropylene of an irradiatable type approved for medical use.

Whether or not forming part of a system according to the present invention, the adaptor is preferably presented sterile and overwrapped.

A yet further aspect of the present invention provides a method of preparing an injectable composition, the method comprising transferring a reconstitution liquid from a blow-fill-seal ampoule to a vial containing an unreconstituted composition by means of a transfer adaptor and subsequently drawing reconstituted injectable composition into a syringe from the vial via the transfer adaptor.

Figure 2:
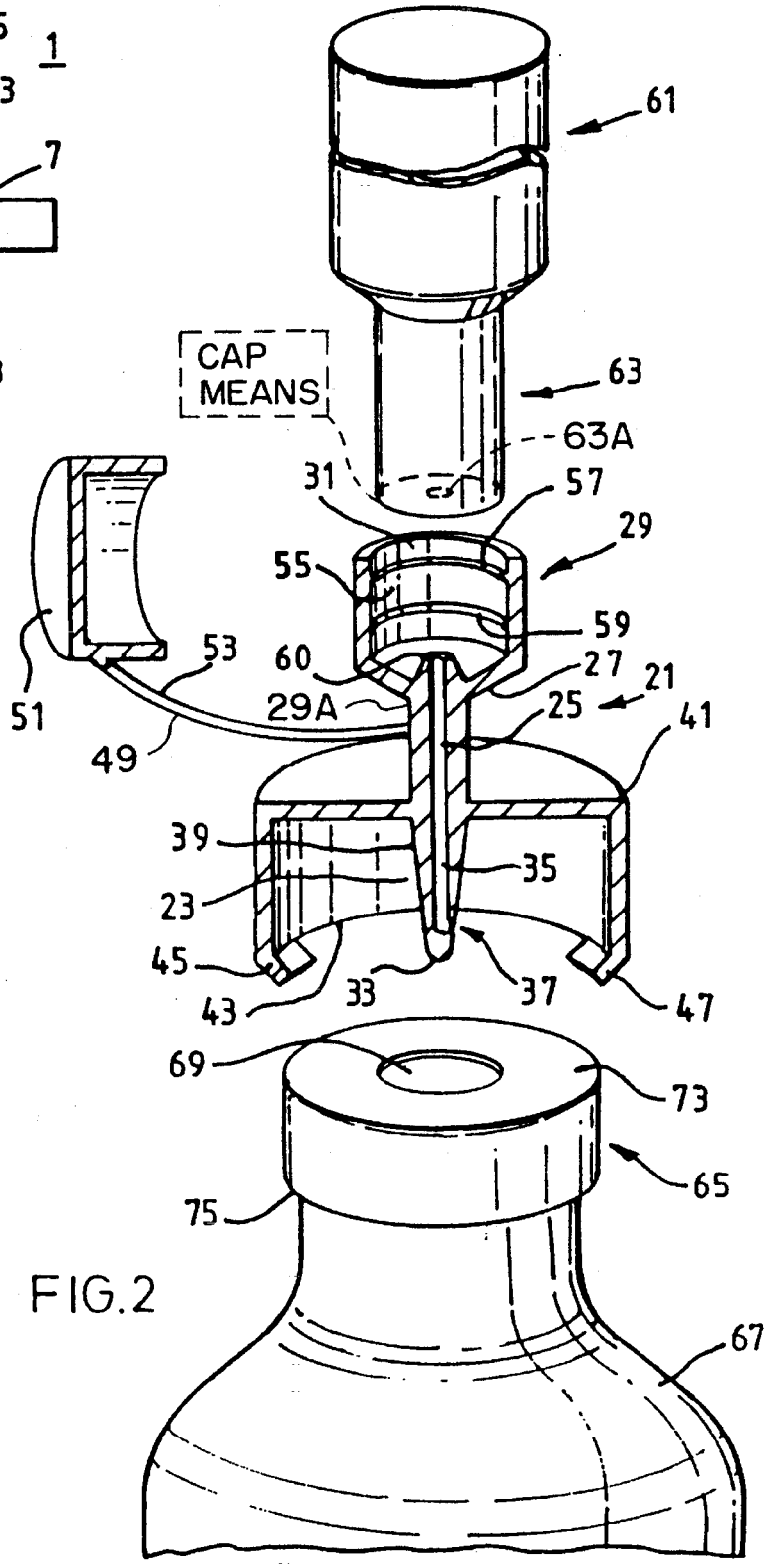
FIG. 2 shows a transfer adaptor and system according to the present invention.

Referring now to the drawings, FIG. 2 shows a transfer adaptor 21 which comprises a rigid cannula 23 having a central bore 25. The upper end (proximal) 27 of the cannula is integral with a female luer 29 which is intended as a connector and defines a receiving chamber 31 which communicates with the bore. The tip 33 of the cannula is rounded. The lower end 35 of the bore terminates in an opening 37 in the side wall 39 of the cannula. The opening may be provided higher in the cannula so that, when the cannula is inserted through a septum (as described below), the opening will be just below the latter.

A cannula shroud 41 extends from approximately the mid-point along the length of the cannula. The lower periphery 43 of the shroud extends to below the lower (distal) end 33 of the cannula and is provided with inwardly extending clips 45, 47.

A strap 49 depends from the cannula at a point between the shroud and the luer. A cap 51 is attached to the end 53 of the strap opposite to the point of attachment.

The inner surface 55 of the female luer 29 is provided with circumferential ribs 57, 59 facing into the receiving chamber, although in some embodiments, the ribs may be omitted.

The lower end of the receiving chamber tapers inwardly frustoconically to terminate in an annular rim 60 at the junction with the cannula bore.

The entire adaptor is injection molded as a single piece.

In use, an ampoule 61 which contains sterile water is opened and a male luer 63 of the ampoule is introduced into the receiving chamber of the female luer of the adaptor. Sealing and temporary retention is facilitated by the ribs 57, 59. However, if these are omitted, then the tolerances of the respective parts are engineered to enable an interference fit to achieve the desired sealing and retention. Sealing is also enhanced by abutment of female portion 63A of the male luer 63 against the annular rim 60.

The adaptor with the ampoule attached is then pushed over the neck 65 of a vial 67, which contains a dried injectable composition, so that the tip of the cannula punctures the rubber septum 69 of the vial. The septum seals against the side wall of the cannula so that external air is excluded from the vial. The adaptor is pushed down until the upper flange 71 of the shroud abuts the upper rim 73 of the vial neck and the clips 45, 47 engage the lower rim 75 of the neck. As mentioned above, screw rifling on the inner surface 76 of the shroud is an alternative means of achieving retention.

As soon as the cannula has punctured the septum, a vacuum in the vial draws the water from the ampoule through the adaptor and into the vial to reconstitute the injectable composition. If necessary, this can be facilitated by shaking.

After the composition has been reconstituted, the ampoule is removed and discarded. The male luer of a syringe is then inserted into the reception chamber of the female luer. The luer of the syringe corresponds in external shape and dimensions to those of the male luer on the blow-fill-seal ampoule. The syringe is then operated to draw-up a desired amount of the reconstituted injectable composition.

If there is a significant delay between reconstituting the composition and charging of the syringe, or if the vial is intended for multiple use, then the cap 51 can be pushed tightly over the female luer to maintain the sterility of the vial contents. During use, the adaptor is retained on the vial by means of the clips 45, 47.

When the contents of the vial are exhausted, the vial with the attached adaptor are discarded as a single unit, having no exposed sharp protrusions, usually known as "sharps", which could come into contact with hospital personnel.

FIG. 18 shows an alternative arrangement which is essentially the same as that shown in FIG. 2, except that the external surface 72 of the connector 73 of the alternative adaptor 75 is frustoconically tapered. The latter removably engages and seals against the inside surface 77 of a female connector 79 of a blow-fill-seal ampoule 81. The latter connector is configured especially for use in this application. To that extent, the connector 73 acts as a male cone.

However, as with the embodiment shown in FIG. 2, the connector 73 is also provided with reception chamber 83 and so, in that respect, also comprises a female luer. Otherwise, the embodiment of FIG. 3 functions in the same way as that of FIG. 2. After the ampoule has been removed, the male luer of a syringe is inserted in the reception chamber of the luer 73.

FIG. 4 shows a further embodiment of the invention where the numbering indicates equivalence with that of the preceding Figures. Essentially, in this embodiment, cap 51 is attached via a living hinge 85 generated during the injection-molding process. Flanges 87 cooperate with flanges 89 to protect male luer 74. In enlargement A, it can be seen that two holes 37 are provided.

Figure 5:
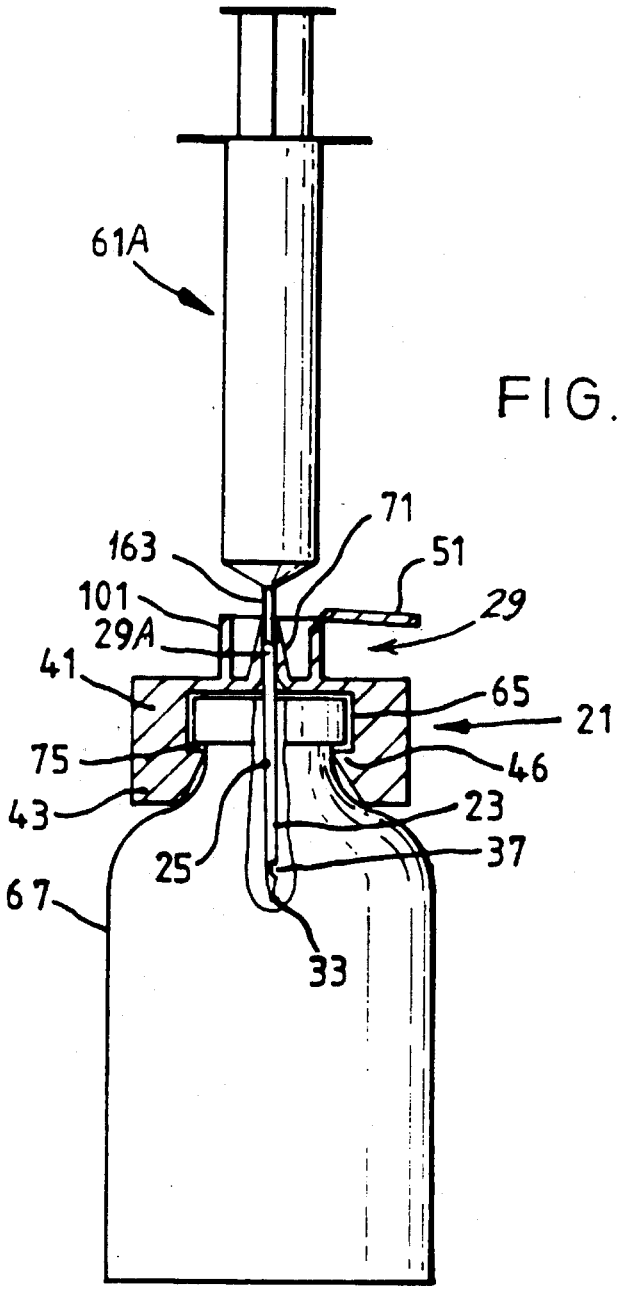
FIG. 5 shows a complete syringe/transfer adaptor/vial system.

FIG. 5 is also similarly numbered. In this system male luer 63 of the syringe 61A syringe is docked in female luer 29, and needle 23 extends into vial 67, via female luer 29A. The assembly is further secured by the action of rim 46 over the bottom 75 of the septum-securing collar.

Figure 6:
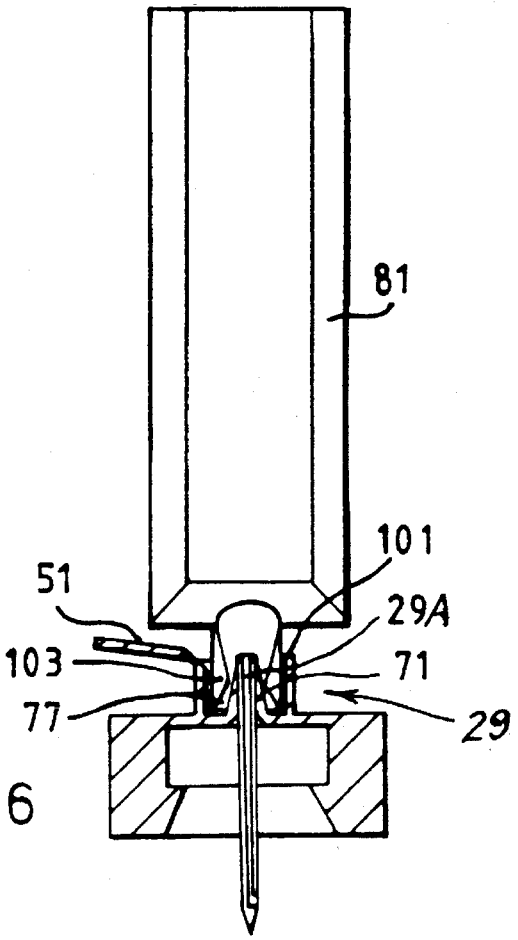
FIG. 6 shows the adaptor of FIG. 5 with an ampoule fitted thereto.

FIG. 6 illustrates the adaptor of FIG. 5 mated to an ampoule 81 via male luer 74 of the adaptor, and female luer 77 of the ampoule. Walls 101 serve to interact with strengthening walls 103 located on the neck of the ampoule.

What is claimed is:

1. A transfer adaptor adapted for fluid communication i) between a vial having septum and a reservoir having a female opening and thereafter ii) between said vial and a syringe having a male exit nozzle, said adaptor comprising:

a cannula, said cannula having a proximal end and a distal end, said distal end being adapted to pierce said septum to permit passage of said adaptor into said vial; and a collar located between said proximal and distal ends to prevent said adaptor from passing entirely into said vial through said septum;

and wherein said proximal end of said cannula is configured so as:

a) to provide a male receptor, said male receptor being adapted to receive said female opening of said reservoir, and b) to provide a female receptor located within said male receptor, said female receptor being adapted to receive said male exit nozzle of said syringe.

2. The transfer adaptor of claim 1, wherein said reservoir is a blow-fill seal ampoule.

3. The transfer adaptor of claim 1, wherein said male receptor of said transfer adaptor fits sealingly into said female opening of said reservoir.

4. The transfer adaptor of claim 1, wherein said male receptor of said transfer adaptor is contoured such that said male receptor is adapted to fit exactly into said female opening of said reservoir.

5. The transfer adaptor of claim 1, wherein said male receptor has base and a tip, and is elongated so that said base of said receptor is broader than said female opening of said reservoir, and said tip of said receptor is narrower than said opening.

6. The transfer adaptor of claim 1, wherein said receptors, said opening of said reservoir and said nozzle of said syringe are all essentially luer-shaped.

7. The transfer adaptor of claim 1, wherein said cannula has an internal bore closed at the distal end of the cannula and having an exit through a side of the cannula.

8. The transfer adaptor of claim 1, wherein said entire transfer adaptor is formed as an integral, injection-molded unit.

9. The transfer adaptor of claim 1, wherein said female receptor of said transfer adaptor is contoured to fit exactly with said male exit nozzle of said syringe.

10. The transfer adaptor of claim 1, wherein said collar is sufficiently wide to cover said entire septum of said vial.

11. The transfer adaptor of claim 10, wherein said vial has a septum-retaining collar having a wall, and said collar of said adaptor is further provided with a dependent flange which is adapted to at least partially surround said wall of said septum-retaining collar on said vial.

12. The transfer adaptor of claim 11, wherein at said extent of said flange there is provided an inwardly directed finger which snaps over said septum-retaining collar in use.

13. The transfer adaptor of claim 11, wherein said flange extends axially beyond said distal end of said cannula.

14. The transfer adaptor of claim 1, wherein an upwardly directed wall is provided about the male and female receptors of said transfer adaptor.

15. The transfer adaptor of claim 14, wherein said upstanding wall is provided with a cover.

16. The transfer adaptor of claim 1, wherein said adaptor and said reservoir form a unit, said ampoule being fitted with a septum adapted to be punctured by said male receptor of said transfer adaptor when said unit is forced onto said vial.

17. The transfer adaptor of claim 1 wherein said cannula has a closed end and being provided with an opening in a side wall thereof.

18. An injection reconstitution system comprising a blow-fill-seal ampoule which contains liquid and a transfer adaptor as defined in claim 1, said ampoule having a female opening covered by a removable cap, said opening being mateable with said male receptor of said transfer adaptor.

19. A method of preparing an injectable composition, said method comprising transferring a reconstitution liquid from a blow-fill-seal ampoule to a vial containing an unreconstituted composition by means of a transfer adaptor as defined in claim 1, and subsequently drawing reconstituted injectable composition into a syringe from said vial via said transfer adaptor.

20. A transfer adaptor adapted for fluid communication between a vial and, independently, a reservoir and a syringe, wherein the vial includes a septum, the reservoir includes an opening extending therethrough and the syringe includes an exit nozzle attached thereto, the adaptor comprising a cannula, the cannula having a proximal end and a distal end, the distal end being adapted to pierce the septum of the vial to permit passage of the adaptor into the vial; and a shroud disposed between the proximal and distal ends adapted for engagement with the vial and to prevent the adaptor from passing entirely into the vial during engagement with the vial and wherein the proximal end of the cannula comprises:

a) a first receptor formed to receive the opening of the reservoir, and b) a second receptor disposed within the first receptor and integral therewith for receiving the exit nozzle of the syringe.

* * * * *